United States Patent [19]

Kitagawa

[11] Patent Number: 4,937,404

[45] Date of Patent: Jun. 26, 1990

[54] JACK WITH A SWITCH

[75] Inventor: Toshiya Kitagawa, Kashiwara, Japan

[73] Assignee: Hosiden Electronics Co., Ltd., Osaka, Japan

[21] Appl. No.: 347,618

[22] Filed: May 5, 1989

[30] Foreign Application Priority Data

May 16, 1988 [JP] Japan ..... 63-64916[U]

[51] Int. Cl.[5] ..... H01R 33/96

[52] U.S. Cl. ..... 200/51.09; 200/51.1

[58] Field of Search ..... 200/51.09, 51.11, 51.10, 200/51.12, 243; 439/188, 344, 676; 350/96.20

[56] References Cited

U.S. PATENT DOCUMENTS

| | | | |
|---|---|---|---|
| 3,418,438 | 12/1968 | Barrett | 200/51.1 |
| 3,435,163 | 3/1969 | Bailey et al. | 200/51.1 |
| 3,812,310 | 5/1974 | Gasparaitis et al. | 200/51.1 |
| 4,426,558 | 1/1984 | Tanaka et al. | 200/51.09 |
| 4,633,048 | 12/1986 | Komatsu | 200/51.1 |
| 4,725,241 | 2/1988 | Bertini et al. | 439/188 |
| 4,778,240 | 10/1988 | Komatsu | 200/51.1 |
| 4,846,719 | 7/1989 | Iweshita | 350/96.2 |

FOREIGN PATENT DOCUMENTS

| | | | |
|---|---|---|---|
| 59-17098 | 5/1984 | Japan . | |
| 59-37983 | 10/1984 | Japan . | |
| 60-31168 | 9/1985 | Japan . | |
| 2112589 | 7/1983 | United Kingdom | 439/188 |

*Primary Examiner*—Henry J. Recla
*Assistant Examiner*—Glenn T. Barrett
*Attorney, Agent, or Firm*—Pollock, VandeSande and Priddy

[57] ABSTRACT

A jack with a switch includes a square-sectioned body of an insulating resin material which has on its front a cylindrical sleeve for receiving a plug, and an open rear end. The body has an internal regulating rib molded integrally therewith and extending from the rear end of the sleeve toward the rear opening of the body through a hole made in a leaf contact piece, for limiting inclination of a plug inserted into the body. An L-shaped lug is inserted into the body through its rear opening so that the tip of the plug is gripped by top and bottom contact pieces extending from the lug. A separator, inserted into the body through its rear opening, has a U-shaped base portion for receiving the tip end portion of the plug and a pair of movable pieces extending from right and left end portions of the base toward the sleeve. When the plug is inserted, the movable pieces are displayed outwardly in opposite directions to thereby turn ON or OFF contact piece switches formed in the body, and at the same time the tip end portion of the plug is received by the U-shaped base portion of the separator, by which lateral movement of the plug is prevented. A rotatable cover is molded integrally with the body along one marginal edge of the rear opening to cover the opening.

6 Claims, 4 Drawing Sheets

JACK WITH A SWITCH

BACKGROUND OF THE INVENTION

The present invention relates to a jack with a switch in which, upon insertion thereinto of a plug, a separator of an insulator material is driven for ON-OFF control of contact pieces.

Jacks of this kind are disclosed in Japanese Utility Model Publications No. 59-17098, No. 59-37983 and No. 60-31168. These conventional jacks allow the tip of a plug inserted therein to badly oscillate and is not robust against the resultant twisting.

SUMMARY OF THE INVENTION

It is therefore an object of the present invention to provide a jack with a switch which is simple-structured, easy to assemble, robust against twisting by a plug inserted thereinto and firmly grips the plug.

According to the present invention, the body of the jack has in its inside a rib, for limiting inclination of a plug, which is molded integrally with the body and extends from the position of a plug insertion sleeve toward a rear opening of the body opposed to the sleeve. An L-shaped lug of a metal material is inserted into the body through its rear opening and the lug has a tip contact piece which extends from its plate portion parallel to the direction in which the plug is inserted into and pulled out of the jack, and a receiving contact piece which extends perpendicularly from its plate portion opposed to the rear opening of the body toward the sleeve. The tip contact piece has a hole for receiving the rib, and the receiving contact piece has a hole for receiving a side portion of the tip of the plug. A ring contact piece and a grounding contact piece are inserted into the body and disposed opposite the tip contact piece. A separator of an insulating material is disposed between the ring contact piece and the tip contact piece. The separator has a U-shaped base portion into which the tip of the plug is fitted. A pair of movable pieces extend forward from the base portion of the separator and are held displaceable in a direction perpendicular to the direction in which the plug is inserted into and pulled out of the jack. Furthermore, a support arm extends from the base portion of the separator. A leaf and a plate contact pieces are inserted into the body through its rear opening and disposed opposite each movable piece. Upon insertion of the plug, the movable piece is driven, by which the leaf and plate contact pieces are ON-OFF controlled. A cover is molded integrally with the body along its one marginal edge at the rear open end in a manner to be rotatable about the marginal edge. The cover closes the rear opening of the body and is locked thereto by claws.

DESCRIPTION OF THE PREFERRED EMBODIMENT

Figure 1:
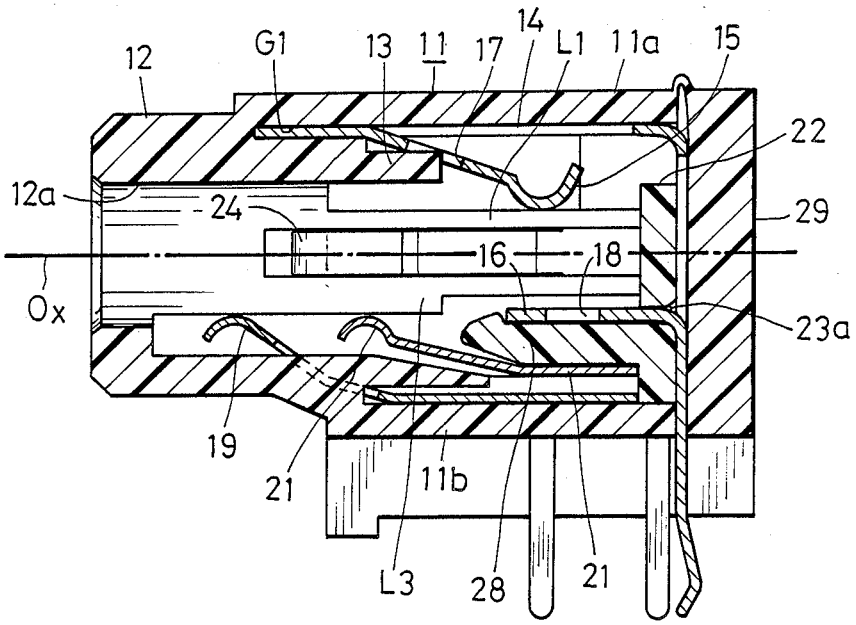
FIG. 1 is a vertical sectional view illustrating an example of the jack with a switch according to the present invention.
Figure 2:
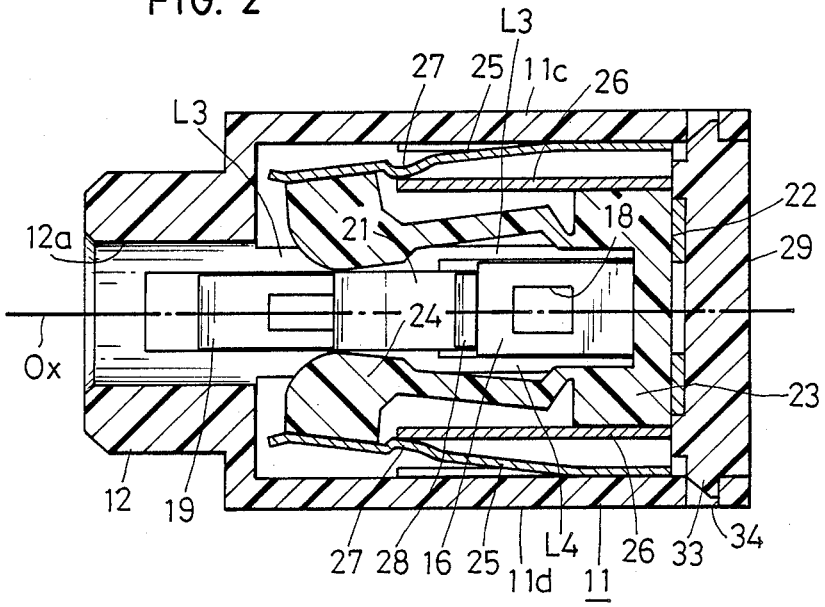
FIG. 2 is a horizontal sectional view of the jack depicted in FIG. 1.
Figure 3:
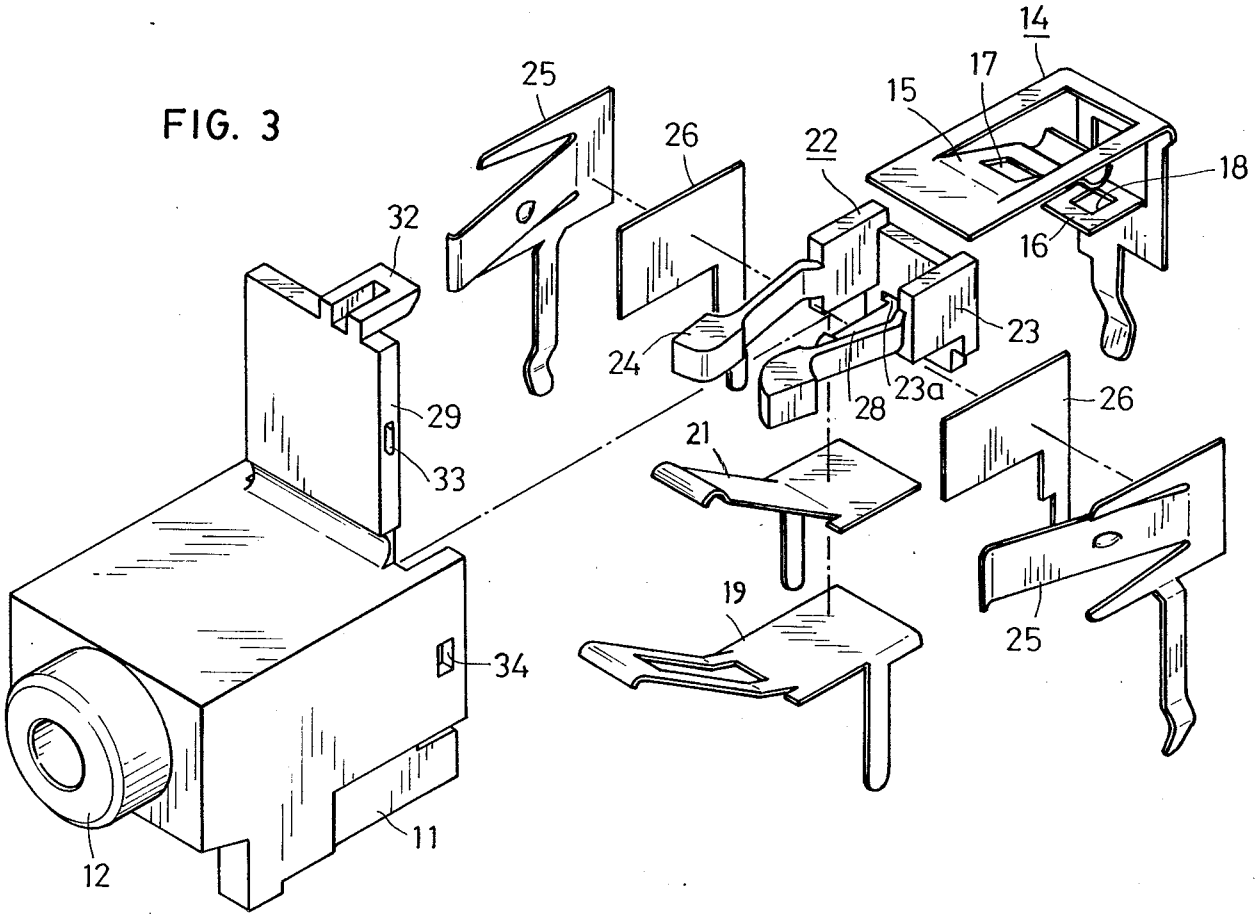
FIG. 3 is an exploded perspective view of the jack shown in FIG. 1.
Figure 4:
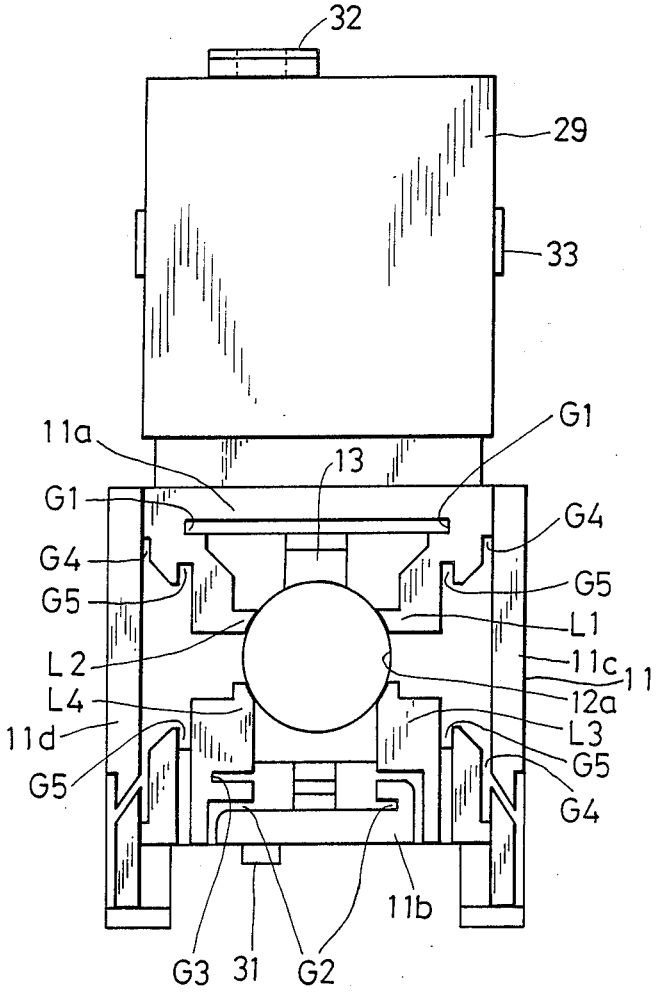
FIG. 4 is a back view of a body 11 in FIG. 3.

FIGS. 1 through 4 illustrate an embodiment of the present invention, FIG. 1 being a vertical sectional view taken along the axis Ox of a plug receiving hole 12*a*, FIG. 2 a horizontal section view taken along the axis Ox, FIG. 3 an exploded perspective view showing parts of the jack of the present invention, and FIG. 4 a rear view of a body 11. The body 11 formed by a molding of an insulating material is square in cross-section and has on its front a cylindrical sleeve 12 molded integrally therewith for the insertion of a plug. The rear of the body 11 is open and has along its one marginal edge a cover 29 molded integrally therewith in a hinge-like fashion.

In the body 11 a regulating rib 13 molded integrally with the sleeve 12 extends therefrom toward the rear opening of the body 11. The rib 13 is flush with the inner peripheral surface of the plug insertion hole 12*a* of the sleeve 12 and limits inclination of a plug inserted in the body 11. In the body 11 there are molded integrally therewith auxiliary ribs L1 through L4 which extend from its four corners toward and in parallel to the axis Ox and the inner end faces of which are flush with the inner peripheral surface of the plug insertion hole 12*a*. The auxiliary ribs L1 through L4 extend from the rear end portion of the sleeve 12 toward the rear opening further than the regulating rib 13.

In the body 11 there is inserted through its rear opening an L-shaped lug 14 of a resilient metal, with its horizontal plate portion received in a groove G1 (FIGS. 1 and 4) along the inner surface of a top panel 11*a* of the body 11 and its vertical plate portion disposed across the rear opening. The lug 14 has a tip contact piece 15 which extends down aslant from that portion of the horizontal plate portion extending along the top panel 11*a* and a receiving contact piece 16 which extends from the vertical plate portion at right angles thereto. The tip contact piece 15 has a hole 17 for receiving the tip of the regulating rib 13 and the receiving contact piece 16 has a hole 18 for receiving a side portion of the tip of a plug.

A grounding contact piece 19 of a resilient metal is inserted into a groove G2 of the body 11 along its bottom panel 11*b* through the rear opening. At a very short distance from the grounding contact piece 19 a ring contact piece 21 of a resilient metal is inserted into a groove G3 of the body 11 through its rear opening. A separator 22 of an insulating resin material is inserted into the body 11 through its rear opening. The separator 22 has a U-shaped base portion 23 for receiving the tip of the plug and a pair of movable pieces 24 extending from the base portion 23 of the separator 22. The movable pieces 24 are disposed in a horizontal plane containing the axis Ox on both sides thereof and they are elastically deflectable in a direction perpendicular to the axis Ox. The base portion 23 is disposed at the rear open end of the body 11 and the movable pieces 24 project out forwardly of the base portion 23. The pair of movable pieces 24 are opposed to side panels 11*c* and 11*d* of the body 11, respectively.

Between the movable pieces 24 and the side panels 11*c* and 11*d* leaf contact pieces 25 and metal plate contact pieces 26 are inserted into grooves G4 and G5, respectively, through the rear opening of the body 11. The leaf contact pieces 25 are disposed along the side panels 11*c* and 11*d*, respectively, and the plate contact pieces 26 are disposed in adjacent but slightly spaced relation. Each leaf contact piece 25 is longer than the adjoining plate contact piece 26 and projects out toward the sleeve 12, and the free end portion of each leaf contact piece 25 makes contact with the free end portion of the corresponding movable piece 24. When no plug is inserted, a contact portion 27 of each leaf contact piece 29 resiliently contacts the corresponding plate contact piece 26 as shown in FIG. 2.

A support arm 28 projects forwardly from the base portion 23 of the separator 22, and the base plate 23 has a slot 23*a* whose inner surface is contiguous to the top surface of the support arm 28. The receiving contact piece 16 of the lug 14 is inserted in the slot 23*a* along the support arm 26. The support arm 28 is disposed on the ring contact piece 21. The lug 14, the grounding contact piece 19, the ring contact piece 21, the leaf contact pieces 25 and the plate contact pieces 26 have terminals which lead out of the bottom panel 11*b* of the body 11 in the direction perpendicular to the axis Ox.

The cover 29 is hingedly coupled at one end to the top panel 11*a* of the body 11 at its rear open end. When the cover 29 is turned about the marginal edge of the top panel 11*a* to the position where it covers the rear open end of the body 11, a claw 31 provided on the underside of the bottom panel 11*b* and a hook 32 of the cover 29 are engaged with each other, and claws 33 protrusively provided on both sides of the cover 29 are engaged with engaging holes 34 made in side panels of the body 11, by which the cover 29 is locked to the body 11.

Figure 5:
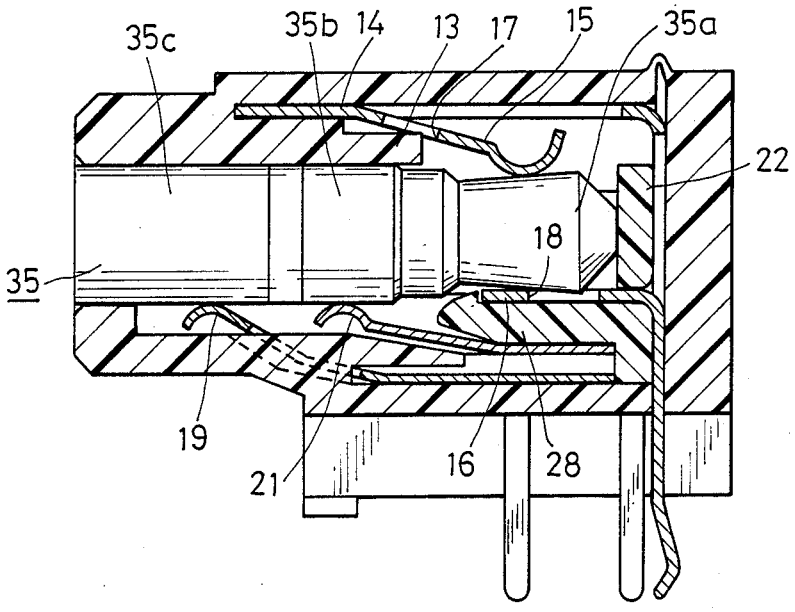
FIG. 5 is a vertical sectional view, corresponding to FIG. 1, showing the state of the jack with a plug inserted therein.
Figure 6:
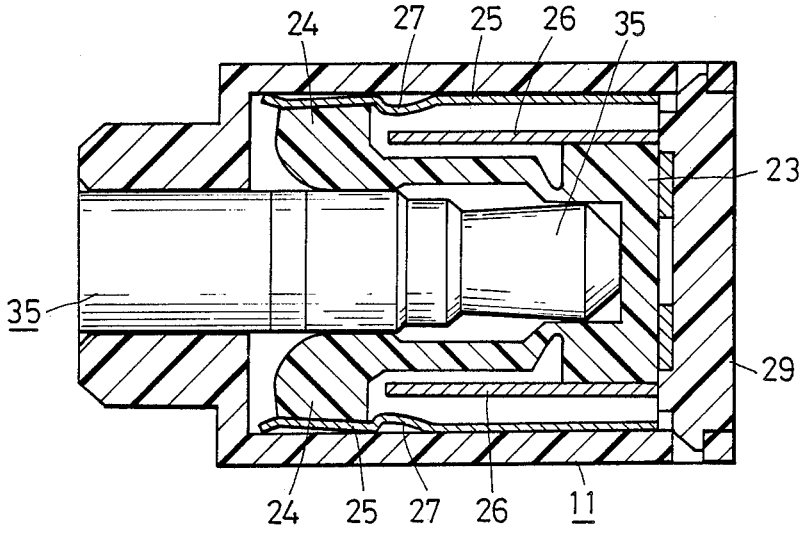
FIG. 6 is a horizontal sectional view, corresponding to FIG. 2, showing the state of the jack with the plug inserted therein.

When a plug 35 is inserted into this jack with a switch, a tip conductor 35*a*, a ring conductor 35*b* and a the grounding conductor 35*c* of the plug 35 resiliently contact the tip contact piece 14, the ring contact piece 21 and the grounding contact piece 19, respectively, as depicted in FIG. 5. Furthermore, as shown in FIG. 6, the pair of movable contact pieces 24 are displaced by the plug 35 outwardly in opposite directions, with the result that the leaf contact pieces 25 are displaced, disengaging their contact portions 27 from the plate contact pieces 26. When the plug 35 is pulled out of the jack, the contact portions 27 resiliently spring back into contact with the plate contact pieces 26 by virtue of the resiliency of the leaf contact pieces 25.

As described above, the jack with a switch according to the present invention has a structure in which various contact pieces are all inserted into the body 11 in the same direction through its rear open end and are fixed by closing the cover 29 molded integrally with the body 11 along one marginal edge of the rear open end portion. Accordingly, this structure makes it easy to incorporate and fix the contact pieces in the body 11.

Since the tip contact piece 15 of the lug 14 has the hole 17 which permits the extension therein of the regulating ribs 13 for limiting inclination of the plug 35, the rib 13 can be made long, providing a structure which is robust against twisting of the plug 35 in the vertical direction.

Since the U-shaped base portion 23 receives the tip of the plug 35 as shown in FIG. 6, the structure of the present invention is also robust against twisting of the plug 35 in the horizontal direction.

Furthermore, the four auxiliary ribs L1 through L4, which are formed extending from four corners of the body 11 toward its center axis, also effectively resist to twisting of the plug 35 in directions about 45 degrees with respect to the horizontal and vertical directions.

As shown in FIG. 5, the tip end portion of the plug 35 is gripped by the tip contact piece 15 and the receiving contact piece 16 and the side portion of the tip of the plug is received by the hole 18, so that the plug 35 can firmly be held in position and the contact with the plug 35 can be highly stabilized.

Moreover, the support arm 28 of the separator 22 fills the gap between the receiving contact piece 16 and the ring contact piece 21, by which the receiving piece 16 can be supported more firmly, ensuring firm gripping of the plug 35.

It will be apparent that many modifications and variations may be effected without departing from the scope of the novel concepts of the present invention.

What is claimed is:

1. A jack with a switch, comprising:

a rectangular hollow body of an insulating material having a front face, a rear face, and an interior, said body having an opening at said rear face and a plug insertion sleeve molded integrally on said front face extending forward from said front face, said sleeve having a plug insertion hole communicating with the interior of said hollow body for receiving a plug wherein said plug insertion hole has an axis;

a regulating rib molded integrally with the interior of said hollow body for limiting inclination of a plug that is inserted into said plug insertion hole, said regulating rib extending from an inner surface of said front face of said body toward said rear opening of said body;

an L-shaped lug of metal inserted into said body through said rear opening thereof, said lug having a horizontal plate portion disposed in said body parallel to the axis of said plug insertion hole and a vertical plate portion disposed in said body opposite said rear opening, said horizontal plate portion having a tip contact piece formed integrally therewith and extending rearwardly therefrom, said tip contact piece having a hole for receiving said regulating rib;

a ring contact piece and a grounding contact piece inserted into said body through said rear opening thereof and disposed radially opposite to said tip contact piece relative to a plug that is inserted into said plug insertion hole;

a separator formed of an insulating material disposed between said ring contact piece and said tip contact piece, said separator having a base portion adjacent said vertical plate portion of said lug said base portion having two forwardly directed legs such that said base portion is U-shaped wherein a tip of said plug is received between said legs, at least one movable piece extending from one of said legs of said base portion toward said sleeve and displaceable in a direction perpendicular to the axis of said plug insertion hole, and a support arm molded integrally with said base portion and extending toward said sleeve for receiving a side portion of a plug that is inserted into said plug insertion hole;

at least one pair of leaf and plate contact pieces inserted into said body through said rear opening thereof and disposed opposite said at least one movable piece, said leaf and plate contact pieces being subject to ON-OFF control by displacement of said movable piece resulting from insertion and removal of said plug into and out of said plug insertion hole;

a rectangular cover, having a hinge portion that is molded integrally with said body adjacent said rear opening, for closing said rear opening of said body; and locking means formed on said cover and said body adjacent said rear opening, for locking said cover to said body when said rear opening of said body is closed by said cover.

2. The jack of claim 1 wherein said lug has a receiving contact piece extending from said vertical plate portion along a top surface of said support arm toward said sleeve, said receiving contact piece having a hole formed therein for receiving a side portion of the tip of the plug.

3. The jack of claim 3 wherein a pair of said movable pieces is provided such that a movable piece extends from each of said legs along opposite sides of said plug and a pair of said leaf and plate contact pieces is provided in association with each movable piece.

4. The jack of claim 2 or 3 wherein said vertical plate portion of said lug is disposed between said base portion of said separator and said cover, and said receiving contact piece of said lug extends towards said sleeve through a slot made in said base portion.

5. The jack of claim 1 further comprising four auxiliary ribs molded integrally with the interior of said rectangular hollow body, said four auxiliary ribs respectively protruding diagonally from four parallel internal corner edges of said hollow body toward the axis of said plug insertion hole, a top face of each of said auxiliary ribs extending from an inner peripheral surface of said plug insertion hole toward said rear opening of said body.

6. The jack of claim 1 wherein said regulating rib is molded integrally with said body along an inner wall surface of said body extending parallel to the axis of said plug insertion hole.

* * * * *